US007597137B2

(12) United States Patent
Nelson et al.

(10) Patent No.: US 7,597,137 B2
(45) Date of Patent: Oct. 6, 2009

(54) HEAT EXCHANGER SYSTEM

(75) Inventors: Bruce I. Nelson, Colville, WA (US); Delbert A. Morris, Colville, WA (US)

(73) Assignee: Colmac Coil Manufacturing, Inc., Colville, WA (US)

( * ) Notice: Subject to any disclaimer, the term of this patent is extended or adjusted under 35 U.S.C. 154(b) by 215 days.

(21) Appl. No.: 11/712,847

(22) Filed: Feb. 28, 2007

(65) Prior Publication Data

US 2008/0202738 A1 Aug. 28, 2008

(51) Int. Cl.
*F28F 9/04* (2006.01)

(52) U.S. Cl. ..... 165/174; 165/178; 62/525

(58) Field of Classification Search ..... 165/174, 165/178; 62/525
See application file for complete search history.

(56) References Cited

U.S. PATENT DOCUMENTS

| | | | | |
|---|---|---|---|---|
| 1,926,517 | A | | 9/1933 | Filippi et al. |
| 2,209,325 | A | | 7/1940 | Dennis |
| 2,769,231 | A | | 11/1956 | Grenell |
| 2,800,344 | A | | 7/1957 | Wolcott |
| 2,823,933 | A | | 2/1958 | Hickman et al. |
| 3,119,632 | A | | 1/1964 | Skinner |
| 3,137,937 | A | | 6/1964 | Cowan et al. |
| 3,233,312 | A | | 2/1966 | Cowan et al. |
| 3,264,731 | A | | 8/1966 | Chudzik |
| 3,397,444 | A | | 8/1968 | Bergmann et al. |
| 3,583,062 | A | | 6/1971 | Sharp, Jr. et al. |
| 3,583,064 | A | | 6/1971 | Costello et al. |
| 3,602,978 | A | | 9/1971 | Oaks |
| 3,664,816 | A | | 5/1972 | Finnegan |
| 3,689,232 | A | | 9/1972 | Baba et al. |
| 3,798,010 | A | | 3/1974 | Sharp, Jr. et al. |
| 3,798,011 | A | | 3/1974 | Sharp, Jr. |
| 3,876,136 | A | | 4/1975 | Bomberger, Jr. |
| 3,910,478 | A | | 10/1975 | Howell et al. |
| 4,010,965 | A | | 3/1977 | Izuma et al. |
| 4,231,506 | A | | 11/1980 | Istvanffy et al. |
| 4,496,096 | A | | 1/1985 | Persson |
| 4,543,802 | A | * | 10/1985 | Ingelmann et al. ..... 62/525 |
| 4,702,406 | A | | 10/1987 | Sullivan et al. |
| 4,770,240 | A | | 9/1988 | Dawson et al. |
| 4,981,250 | A | | 1/1991 | Persson |
| 4,988,130 | A | | 1/1991 | Obara et al. |
| 5,190,101 | A | | 3/1993 | Jalilevand et al. |
| 5,213,904 | A | | 5/1993 | Banker |
| 5,836,623 | A | | 11/1998 | Bothell et al. |
| 5,975,590 | A | | 11/1999 | Cowan et al. |
| 6,023,940 | A | * | 2/2000 | Abbott et al. ..... 62/504 |
| 6,315,487 | B1 | | 11/2001 | James |
| 6,843,509 | B2 | | 1/2005 | Nelson |
| 6,886,629 | B2 | | 5/2005 | Dietrich |
| 2005/0263568 | A1 | | 12/2005 | Stol |

FOREIGN PATENT DOCUMENTS

| | | |
|---|---|---|
| GB | 1294522 | 1/1970 |

* cited by examiner

*Primary Examiner*—Teresa J Walberg
(74) *Attorney, Agent, or Firm*—Wells St. John P.S.

(57) ABSTRACT

A heat exchanger system is described and which includes a metal tubular heat exchanger; a fluid distributor conduit fabricated from a metal dissimilar to that of the heat exchanger, and wherein the fluid distributor conduit is connected in fluid flowing relation relative to the metal tubular heat exchanger; and a fluid distributor made of a metal that is similar to that of the fluid distributor conduit, and which is connected in fluid flowing relation relative to the fluid distributor.

8 Claims, 5 Drawing Sheets

HEAT EXCHANGER SYSTEM

TECHNICAL FIELD

The present invention relates to a heat exchanger system, and more specifically, to a metal tubular heat exchanger connected to a fluid distributor assembly fabricated from a dissimilar metal.

BACKGROUND OF THE INVENTION

Heat exchanger systems are used in a large variety of industrial, commercial, and consumer applications. Aluminum has been used successfully for many years in the construction of many types of heat exchanger systems due to its physical properties. Aluminum is lightweight, has high thermal conductivity, good corrosion resistance, and further has a relatively low cost. Aluminum is also widely used in industrial heat exchanger systems because of its compatibility with ammonia and halocarbons, which are commonly used with same.

Evaporator heat exchangers, such as those used in industrial refrigeration systems, are fed with refrigerants in a number of different ways. One popular method for controlling the flow of refrigerant to the evaporator is by direct, or "dry," expansion. This method employs an automatic expansion valve which modulates so as to maintain a preset, constant amount of heat at the exit of the heat exchanger. Larger direct expansion evaporators will generally be constructed with two or more parallel refrigerant circuits. Each of these multiple parallel circuits must be supplied with equal amounts of refrigerant from the exit of the expansion valve. To do this, a refrigerant distributor is used to deliver equal mass flow to each of the refrigerant circuits. The refrigerant distributor assembly includes a conical body with an inlet at one end of the conical body and multiple outlet ports which are equally spaced around the perimeter of the base of the body. A small diameter conduit, called a distributor "lead" or conduit, fluidly connects each port in the distributor to each refrigerant circuit in the heat exchanger.

Traditionally, aluminum tube, direct expansion heat exchangers have necessarily utilized aluminum distributor bodies and distributor leads. Because of the difficulties associated with welding small diameter aluminum tubing, these aluminum distributor assemblies and leads have been inherently prone to cracking and leaks, especially in the region surrounding the welding zone located at either end of the respective leads. Ammonia refrigerant leaks, of course, present risks of fire and explosions and immediate health risks to persons nearby. Halocarbon refrigerant leaks present serious environmental problems that may lead to civil liabilities for the user thereof.

In view of the problems associated with the prior art devices and practices utilized heretofore, there has been a long felt need for an improved aluminum heat exchanger system. The prior art is replete with numerous examples of couplers for coupling conduits fabricated from different metals. For example, U.S. Pat. No. 6,886,629 teaches the use of a steel header applied to an aluminum plate heat exchanger. However, the welding method disclosed in that patent does not appear to be useful for a refrigerant distributor assembly having multiple small-diameter tubular leads, such as those used in a direct expansion evaporator heat exchanger. Additionally, mating dissimilar metal tubes using explosion welding or roll bonding is well known in the art. For example, U.S. Pat. No. 6,843,509, which is incorporated by reference herein, teaches an explosively welded coupler for joining a steel or stainless steel conduit to an aluminum conduit when those conduits have similar outer diameter dimensions. The particular teachings of that patent, however, do not appear to be useful for solving the several problems identified above, and more specifically where a small diameter stainless steel distributor lead must be mated with a larger diameter aluminum heat exchanger tube.

A metal tubular heat exchanger system connected to a fluid distributor fabricated from a dissimilar metal, and which avoids the shortcomings attendant with the prior art devices and practices utilized heretofore, is the subject matter of the present application.

SUMMARY OF THE INVENTION

A first aspect of the invention relates to a heat exchanger system that includes a metal tubular heat exchanger; a fluid distributor conduit fabricated from a metal dissimilar to that of the heat exchanger, and wherein the fluid distributor conduit is connected in fluid flowing relation relative to the metal tubular heat exchanger; and a fluid distributor made of a metal that is similar to that of the fluid distributor conduit, and which is connected in fluid flowing relation relative to the fluid distributor.

Another aspect of the invention relates to a heat exchanger system that includes a plurality of aluminum heat exchanger tubes; a plurality of fluid distributor conduits fabricated from steel or stainless steel; a fluid distributor fabricated from steel or stainless steel, and wherein each of the plurality of fluid distributor conduits is coupled in fluid flowing relation relative to the fluid distributor; and a plurality of couplers for joining each of the plurality of aluminum heat exchanger tubes in fluid flowing relation relative to each of the plurality of fluid distributor conduits.

Yet another aspect of the invention relates to a heat exchanger system that includes a plurality of aluminum heat exchanger tubes; a plurality of fluid distributor conduits fabricated from steel or stainless steel; a fluid distributor fabricated from steel or stainless steel and wherein each of the plurality of fluid distributor conduits is coupled in fluid flowing relation relative to the fluid distributor; and a plurality of couplers for joining each of the of the plurality of aluminum heat exchanger tubes in fluid flowing relation relative to each of the plurality of fluid distributor conduits, and wherein each coupler has a main body which has a first layer of aluminum, and a second layer of steel or stainless steel, and wherein a third layer of chromium is located therebetween the first and second layers, and wherein the first, second, and third layers are roll bonded together, and wherein each of the first, second, and third layers define a passageway which extends therethrough the main body, and wherein the respective aluminum heat exchanger tubes are individually welded to the first aluminum layer of one of the couplers, and the respective fluid distributor conduits are individually welded to the second steel or stainless steel layer of one of the couplers.

Yet another aspect of the invention relates to a heat exchanger system that includes a plurality of aluminum heat exchanger tubes; a plurality of refrigerant distributor conduits fabricated from steel or an stainless steel alloy; a refrigerant distributor fabricated from steel or an stainless steel alloy, and wherein each of the plurality of refrigerant distributor conduits are coupled in fluid flowing relation relative to the refrigerant distributor; and a plurality of couplers for individually joining in fluid flowing relation each of the plurality of aluminum heat exchanger tubes to each of the plurality of refrigerant distributor conduits, and wherein each of the plurality of couplers comprises a substantially annular shaped first aluminum layer which has a first hardness; a substantially annular shaped second aluminum layer which has a second hardness that is less than the first hardness; a substantially annular shaped third titanium layer juxtaposed relative to the second aluminum layer; a substantially annular shaped fourth steel or an stainless steel alloy layer juxtaposed relative to the third titanium layer, and wherein the respective layers are explosively welded together to form a ring shaped main body, and wherein the respective aluminum heat exchanger tubes are welded to the outside facing surface of the first aluminum layer of one of the couplers, and wherein the respective refrigerant distributor conduits are welded to the outside facing surface of the fourth steel or stainless steel alloy layer of one of the couplers.

Still another aspect of the invention relates to a heat exchanger system that includes a plurality of aluminum heat exchanger tubes which have an outside diameter dimension and an inner diameter dimension; a plurality of fluid distributor conduits fabricated from steel or stainless steel; a fluid distributor fabricated from steel or stainless steel and wherein each of the plurality of fluid distributor conduits is coupled in fluid flowing relation relative to the fluid distributor; a plurality of couplers for joining each of the of the plurality of aluminum tubular heat exchanger tubes in fluid flowing relation relative to each of the plurality of fluid distributor conduits, and wherein each coupler has a substantially ring-shaped first layer of aluminum with a first hardness; a substantially ring shaped second layer of aluminum with a second hardness juxtaposed relative to the first layer, and wherein the second hardness is less than the first hardness; a substantially ring-shaped third layer of titanium juxtaposed relative to the second layer; and a substantially ring-shaped fourth layer of steel or stainless steel juxtaposed relative to the third layer, and wherein the first, second, third, and fourth layers circumscribe the fluid distributor conduit and are explosively welded together.

These and other aspects of the present invention will be described in greater detail hereinafter.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
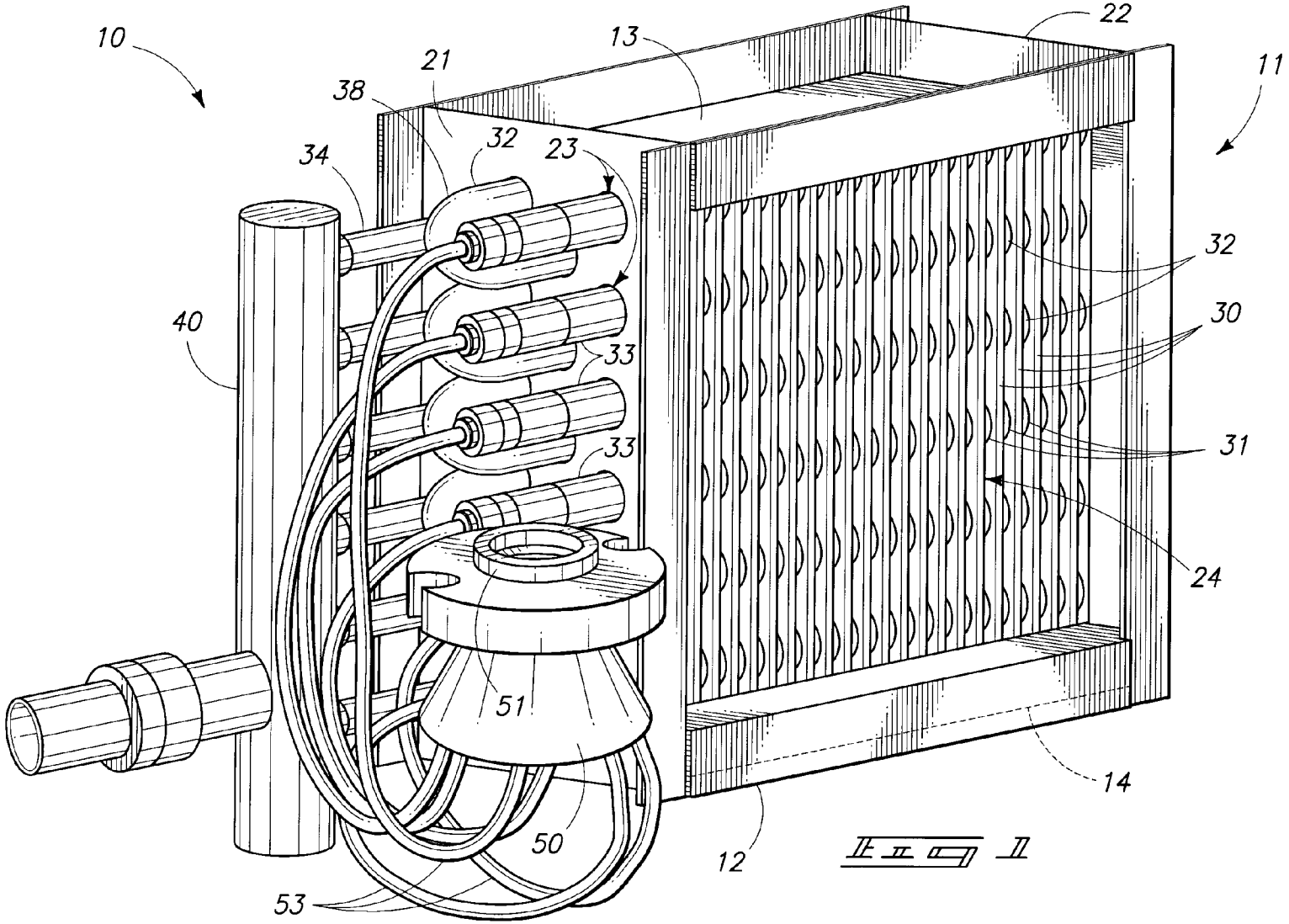
FIG. 1 is a perspective view of a heat exchanger system utilizing the present invention.

Referring now to FIG. 1, the present invention is generally designated by the numeral 10. An aluminum tube evaporator heat exchanger 11 is shown, which might be installed in any of a number of industrial, commercial, or consumer applications. The heat exchanger 11 comprises a housing 12, and which is defined by a top surface 13, a bottom surface 14, a front end wall 21, and a back end wall 22. In the aluminum evaporator heat exchanger 11, these components of the housing 12 are typically fabricated from aluminum or an alloy thereof, however, other structural materials such as steel or stainless steel may also be used. The top surface 13, bottom surface 14, front end wall 21, and back end wall 22 together define the housing cavity 24.

Referring still to FIG. 1, the front end wall 21 of the heat exchanger housing 12 further defines a plurality of apertures 23. A plurality of heat exchanger fins or plates 30 are mounted within the housing cavity 24. Most typically, these fins 30 are fabricated of aluminum or other metal with a high degree of heat conductivity, and are substantially equidistantly spaced in order to maximize their ability to transfer heat to the surrounding air. Each of the plurality of fins 30 also define a plurality of substantially co-aligned fin apertures 31 that are also substantially co-aligned with the front wall apertures 23. A plurality of fluid conducting tubes 32, which are also typically fabricated from aluminum or other metal with a high degree of heat conductivity, extend through the fin apertures 30 and the front wall apertures 23. Each of the plurality of fluid conducting tubes 32 in the heat exchanger 11 has a first intake end 33 and a second output end 34. The fluid conducting tubes 32 may include one or more tube bends 38 to allow the tubes to pass through the heat exchanger cavity 24 multiple times between the intake end 33 and the output end 34. The fluid conducting tubes 32 and the fins 30 are mounted in thermal conducting relation one relative to the other in order to facilitate the transfer of heat from one to the other.

Figure 2:
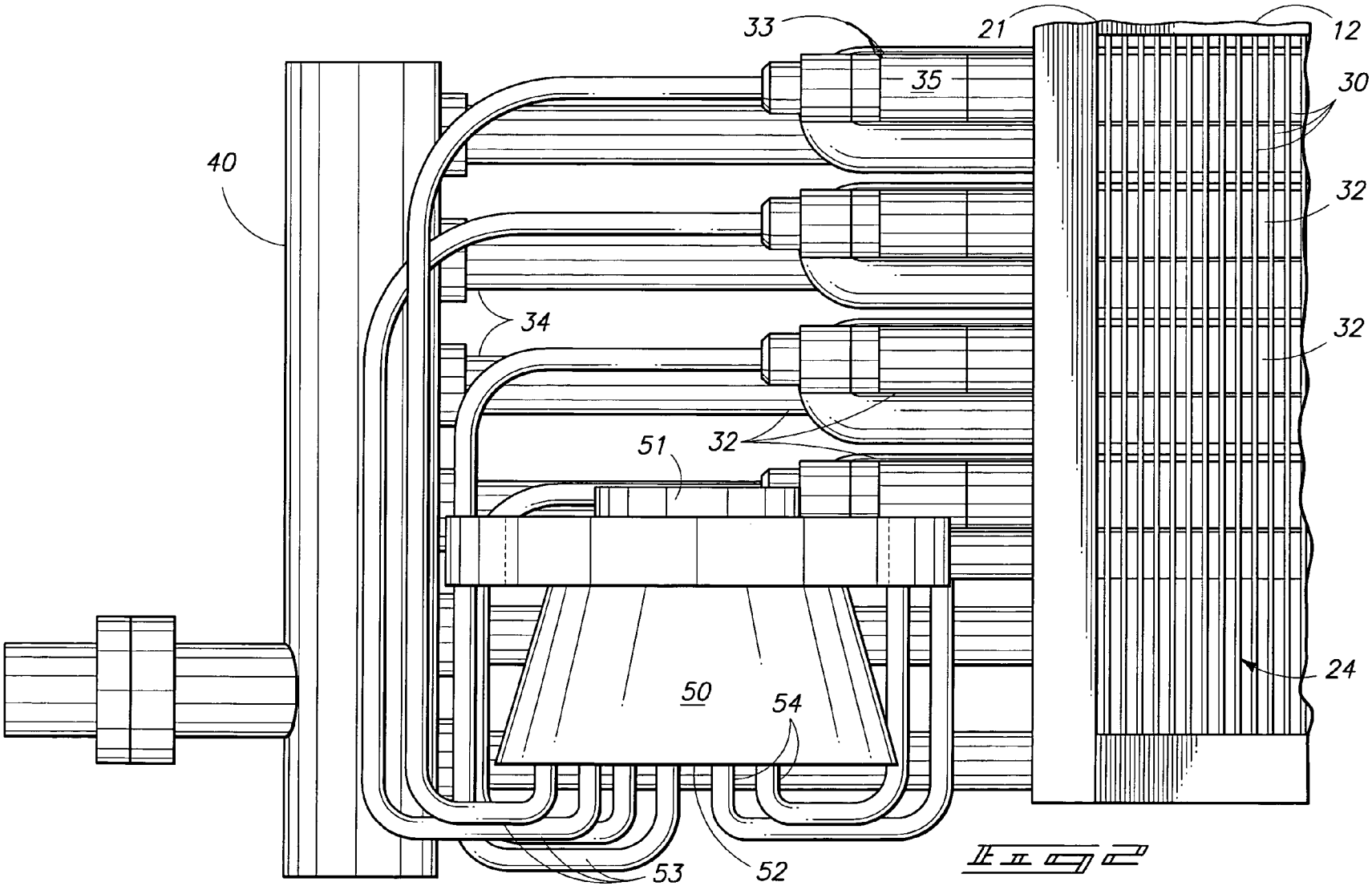
FIG. 2 is a fragmentary, side elevation view of a heat exchanger system utilizing the present invention.
Figure 4:
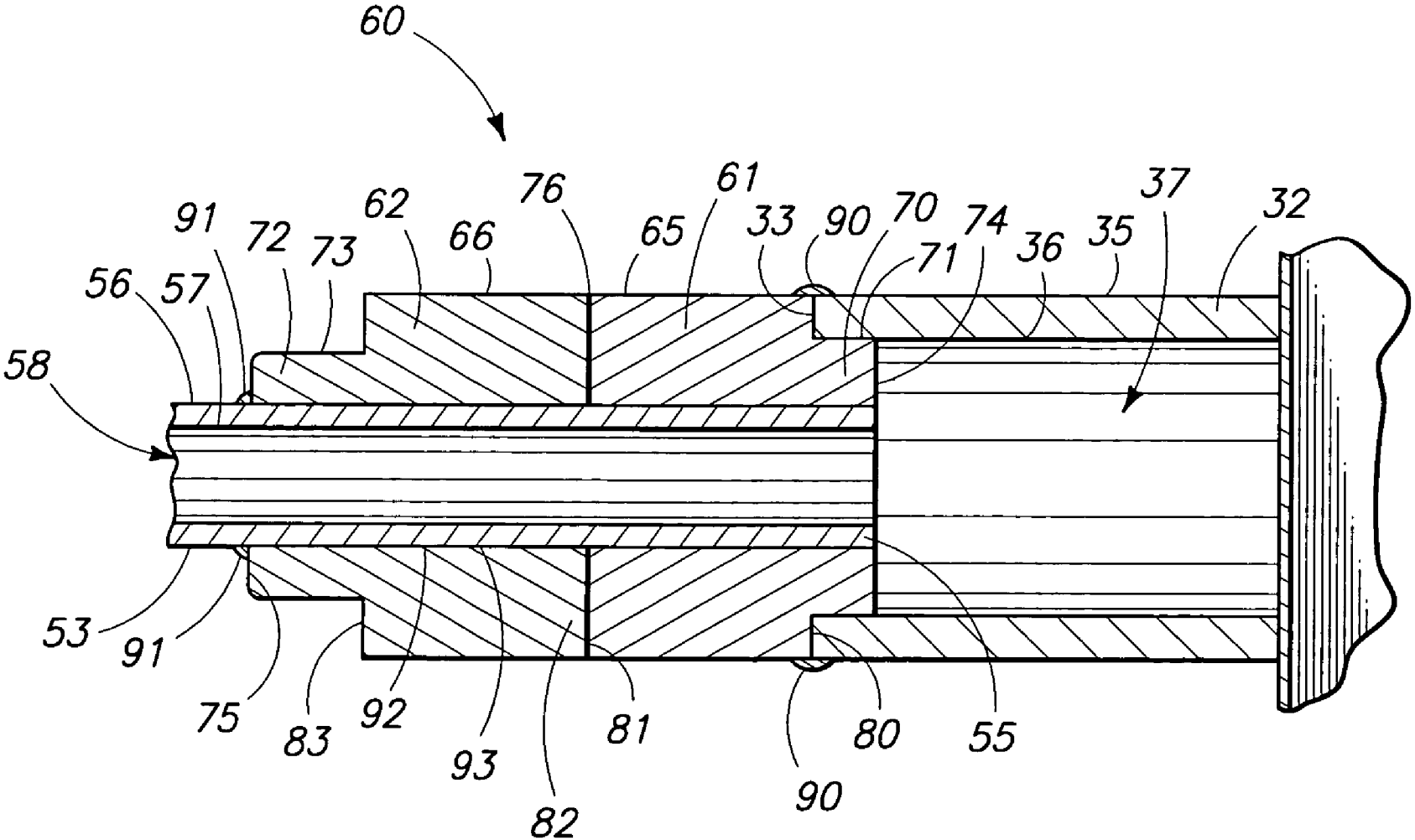
FIG. 4 is a longitudinal cross sectional view of a first form of a coupler which forms a feature of the present invention.
Figure 5:
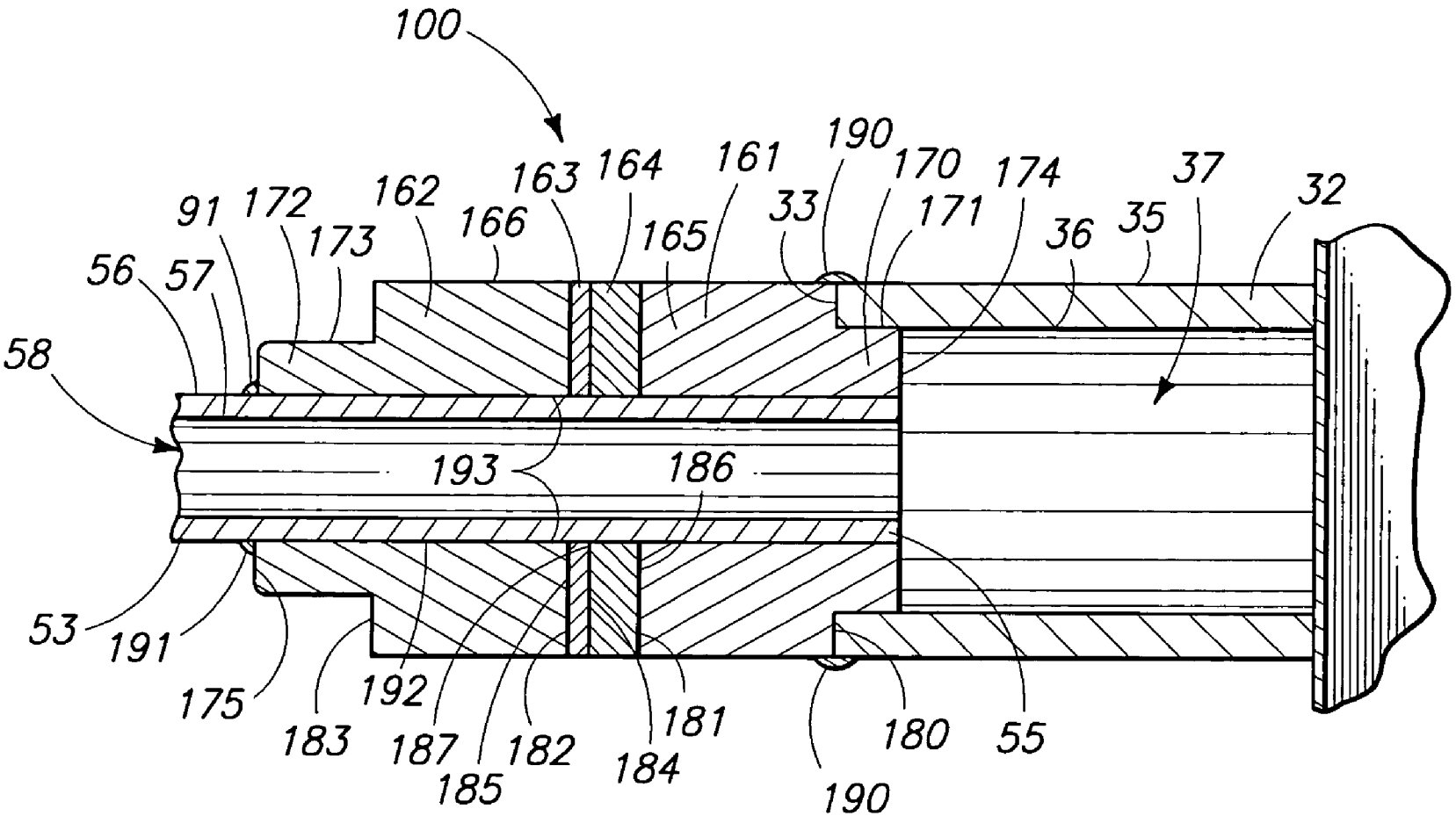
FIG. 5 is a longitudinal cross sectional view of an alternative second form of the coupler which forms a feature of the present invention.

Referring now to FIG. 1 and FIG. 2, the evaporator heat exchanger 11 as shown typically has a plurality of aluminum fluid conducting tubes 32 that conduct a refrigerant fluid from a refrigerant fluid distributor 50, through the heat exchanger cavity 24, and then to a suction manifold 40. The refrigerant fluid distributor 50 includes a first fluid intake end 51, and a second fluid discharge end 52. Refrigerant fluid is discharged from the distributor discharge end 52 using a plurality of fluid distributor conduits 53, commonly referred to in the art as distributor "leads." These distributor conduits or leads 53 are typically fabricated from steel, or more preferably, from stainless steel, which provides a higher degree of corrosion resistance. Moreover, the distributor conduits 53 typically have a smaller outside diameter dimension, relatively speaking, than the inside diameter dimension of the aluminum tubes 32 of the heat exchanger. The outside diameter of the distributor conduits 53 typically range in size from about 3/16 to 3/8 inch, while the outside diameter of the aluminum fluid tubes 32 typically range in size from about 3/8 to about 1 inch. The first end 54 of each of the distributor conduits 53 are connected in fluid flowing relation relative to the discharge end 52 of the fluid distributor 50. The second ends 55 of each the distributor conduits 53 are connected to a coupler which is generally indicated by the numeral 60, and which is further discussed in greater detail, below (FIGS. 4 and 5). The coupler 60 connects each of the respective fluid distributor conduits 53 to the respective first end 33 of each of the plurality of aluminum fluid tubes 32. The second end 34 of each of the plurality of aluminum fluid tubes 32 are then connected in fluid flowing relation relative to the expansion valve 40, as shown on FIG. 1. One skilled in the art will recognize that the number, length, and size of the respective refrigerant fluid distributors 50, distributor conduits 53, couplers 60, and aluminum tubes 32 can be varied depending upon the requirements of the application. It will also be recognized that one salient feature of the invention is the ability to utilize a fluid distributor 50 and distributor conduits 53 that are fabricated from steel or stainless steel in conjunction with an aluminum tube evaporator heat exchanger 11 that utilizes aluminum fluid tubes 32.

Figure 3:
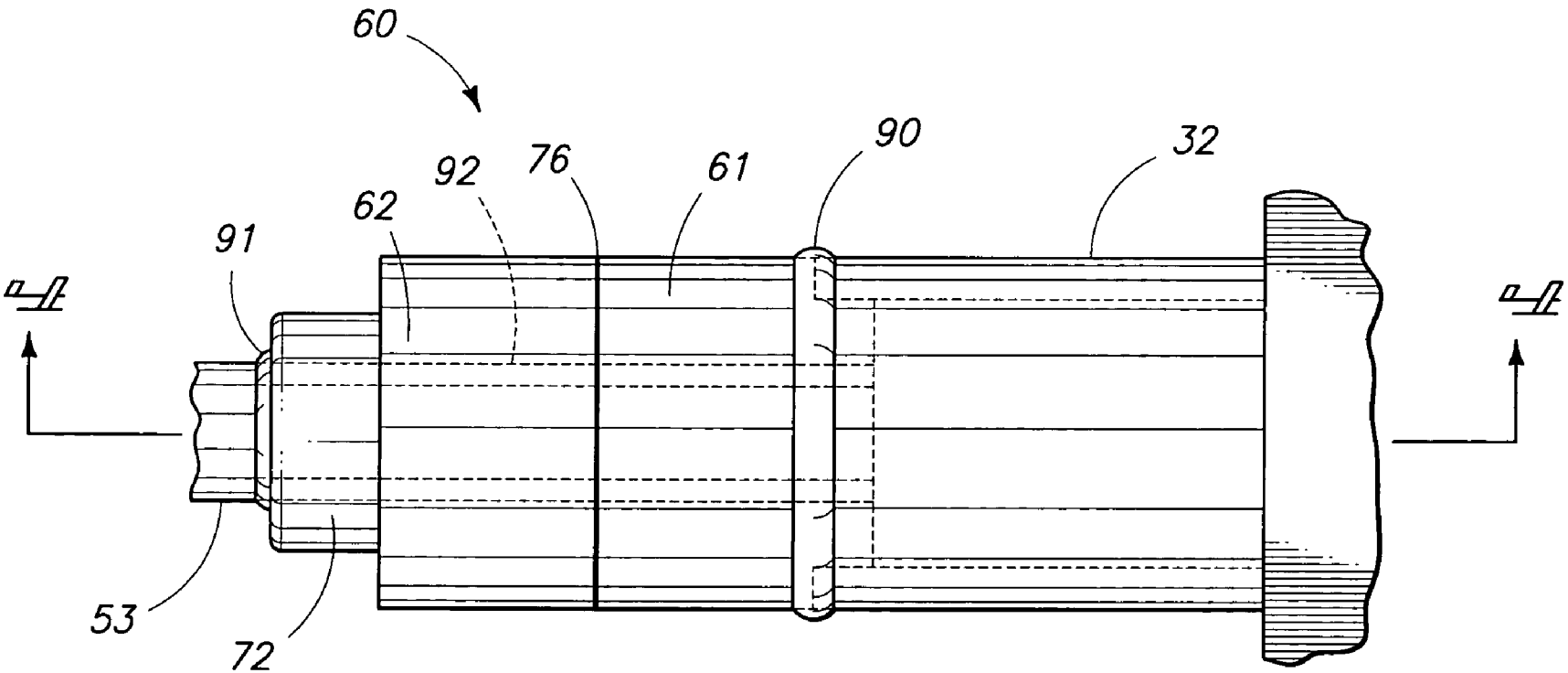
FIG. 3 is a side elevation view of a coupler which forms a feature of the present invention.

Referring now to FIGS. 3-5, the respective couplers 60 that couple the individual distributor conduits 53 to the aluminum tubes 32 are now discussed in greater detail. Two embodiments of the coupler 60 are shown those being, the first embodiment as shown in FIGS. 3 and 4; and the second embodiment as illustrated in FIG. 5. One skilled in the art will recognize that other means for coupling a stainless steel tube to an aluminum tube are possible, and that several variations of the two forms of the couplers as described hereinafter are possible. Also, it will be recognized that the distributor conduits 53 each have an outside facing surface 56, and an opposite inside facing surface 57, which defines an internal passageway 58. Likewise, the aluminum tubes 32 have an outside facing surface 35, and an opposite inside facing surface 36, which defines an internal passageway 37. In the present invention as shown in FIGS. 1-5, the outside diameter dimension of the distributor conduits 53 is less than the inside diameter dimension of the aluminum tubes 32.

FIGS. 3 and 4 illustrate the first embodiment of the coupler 60. In this first embodiment, the coupler 60 includes a first, annular or substantially ring-shaped, aluminum layer 61, and a second, annular or substantially ring-shaped stainless steel layer 62. The first aluminum layer 61 has a thickness that is greater than about 0.25 inches, but typically ranges in thickness from about 0.5 to about 0.75 inches. The first aluminum layer 61 further has a main body 65, which has a first end 80, and an opposite second end 81. Extending coaxially outwardly from the first end 80 is a substantially ring shaped coupling or alignment member 70 that extends coaxially outwardly from the main body 65, and in the direction of the aluminum tube 32. The coupling member 70 is telescopingly received substantially completely within the aluminum tube 32. Further, the coupling member is further defined by an outside facing surface 71 and a distal end 74. The outside diameter dimension of the coupling member 70 is slightly less than about the inside diameter of the aluminum tube 32, so that the outside facing surface 71 of the coupling member 70 is closely juxtaposed relative to the inside facing surface 36 of the aluminum tube 32 along the circumference thereof. The first end 80 of the main body 65 of the first aluminum layer 61 is abutted against the first end 33 of the aluminum fluid tube 32

Referring still to FIGS. 3 and 4, which illustrates the first embodiment of the coupler 60, the second stainless steel layer 62 of the coupler has a main body 66, a first end 82, and an opposite second end 83. The second stainless steel layer 62 typically has a thickness dimension that ranges from about 0.5 inches to about 0.75 inches. The first end 82 of the second stainless steel layer 62 abuts substantially directly against and is juxtaposed relative to the second end 81 of the first aluminum layer 61. Extending substantially coaxially outwardly from the second end 83 is a substantially ring shaped member 72 which has an outside facing surface 73, and a distal end 75. The first aluminum layer 61, and the second stainless steel layer 62 are roll bonded together in this embodiment of the coupler 60. Roll bonding is a technique for bonding two dissimilar metals that is well known in the prior art. Prior to roll bonding, a thin layer of chromium 76 is deposited between the first and second layers 61 and 62, respectively. The resulting coupler 60 has an outside diameter dimension that is substantially the same as the outside diameter dimension of the aluminum tube 32, which typically ranges in size from about ⅜ to about 1 inch. The overall length of the coupler ranges from about 0.5 to about 1.0 inch, and is typically about 0.75 inches long. As earlier discussed, the outside diameter of the coupler 60 is substantially the same as that of the aluminum tube, and the first aluminum layer 61 of the coupler 60 is welded directly to the aluminum tube 32 as seen in FIG. 3. A welding bead 90 can be formed along the outside circumference of the joint between the aluminum conduit 32, and the coupler 60. Likewise, a welding bead 91 is formed along the intersection of the distal end 75 of the member 72 and the distributor conduit 53.

Referring still to FIG. 4, the first aluminum layer 61, and the second stainless steel layer 62 each have an interior facing surface 92 which defines a passageway 93. As seen in FIGS. 3 and 4, the stainless steel distributor conduit 53 extends substantially through the entire length of the interior passageway 93, such that the second end 55 of the stainless steel distributor conduit 53 is positioned adjacent to the distal end 74 of the coupling member 70 of the first aluminum layer 61. Therefore, the coupler 60 thus provides a convenient means of coupling the stainless steel distributor conduit 53 with the aluminum fluid tube 32 of the heat exchanger 11.

Referring now to FIG. 5, a second embodiment of the coupler 100 is shown. In this embodiment of the invention, the coupler 100 includes a first, annular or substantially ring-shaped, aluminum layer 161, which has a main body 165. The main body has a first end 180, and an opposite second end 181. The first aluminum layer 161 further has a thickness dimension that is greater than about 0.25 inches, but typically ranges in thickness from about 0.5 to about 0.75 inches. Extending from the first end 180 is a substantially ring shaped coupling or alignment member 170 that extends substantially coaxially from the main body 165, and in the direction of, and is received within the aluminum tube or conduit 32. The coupling member 170 is telescopingly received substantially wholly within the aluminum tube 32. Further, the coupling member has an outside facing surface 171. The outside diameter dimension of the coupling member 170 is slightly less than the inside diameter of the aluminum tube 32, so that the outside facing surface 171 of the coupling member 180 is juxtaposed relative to the inside facing surface 36 of the aluminum tube 32 and along the circumference thereof. The first end 180 of the main body 165 of the first Aluminum layer 161 is abutted against the first end 33 of the aluminum fluid tube 32.

Referring still to FIG. 5, the second embodiment of the coupler 100 also includes a second, annular or substantially ring-shaped aluminum layer 164. The aluminum layer 164 has a first end 186, and a second end 187. The second end 181 of the first aluminum layer 161 directly abuts and is juxtaposed relative to the first end 186 of the second aluminum layer 164. The aluminum that is used to fabricate the first aluminum layer 161 has a hardness (typically that of T4 aluminum) that is greater than that of the second aluminum layer 164. The second aluminum layer 161 has a thickness that typically ranges from about 0.04 to about 0.10 inches, and it has an outer diameter dimension substantially equal to that of the first aluminum layer. The second embodiment of the coupler 100 also includes a third, annular or substantially ring-shaped titanium layer 163, which has a first end 184, and a second end 185. The second end 187 of the second aluminum layer 164 directly abuts and is juxtaposed relative to the first end 184 of the third titanium layer 163. The third titanium layer 163 has a thickness dimension that typically ranges from about 0.01 to about 0.03 inches, and it has an outer diameter dimension which is substantially equal to that of the first and second aluminum layers. Finally, the second embodiment of the coupler 100 also includes a fourth, annular or substantially ring-shaped steel or stainless steel layer 162, which has a main body 166, and which includes a first end 182, and an opposite, second end 183. The second end 185 of the third titanium layer 163 directly abuts, and is juxtaposed relative to, the first end 182 of the fourth steel or stainless steel layer. The fourth steel or stainless steel layer 162 typically has a thickness dimension that ranges from about 0.5 inches to about 0.75 inches, and the main body 166 has an outer diameter dimension substantially equal to that of the first, second, and third layers. Protruding from the second end 183 is a substantially ring shaped member 172 that extends substantially coaxially outwardly from the main body 166, and in the direction of the distributor conduit 53. This member 172 has an outer diameter dimension which is typically less than the outer diameter dimension of the main body 166, and the outside diameter dimension of the coupling member 170.

Still referring to FIG. 5, the first aluminum layer 161, the second aluminum layer 164, the third titanium layer 163 and the fourth steel or stainless steel layer 162 are explosively welded together to form the second embodiment 100. Explosion welding is a technique for bonding two dissimilar metals that is well known in the prior art. It will be recognized that roll bonding or explosive welding could be used in either the first or second embodiment of the coupler 60. As earlier noted, the resulting coupler 60 has an outside diameter dimension that is substantially the same as the outside diameter dimension of the aluminum tube 32, and which typically ranges from about ⅜ to about 1 inch. The overall length of the coupler ranges from about 0.5 to about 1.0 inch, and is typically about 0.75 inches long. The first aluminum layer 16 of the coupler 60 is welded to the aluminum tube 32. A welding bead 190 can be formed along the outside circumference of the joint between the aluminum fluid tube 32 and the coupler 60. Likewise, a welding bead 191 is formed along the intersection of the end 175 of the protruding member 12 of the fourth steel or stainless steel layer 162 and the steel or stainless steel distributor conduit 53. Further, the first aluminum layer 161, the second aluminum layer 164, the third titanium layer 163, and the fourth steel or stainless steel layer 162 each have an inside surface 192 which defines a passageway 193. As seen in FIG. 5, the steel or stainless steel distributor conduit 53 extends substantially through the entire length of the interior passageway 193, such that the second end 55 of the stainless steel distributor conduit 53 is positioned adjacent to the distal end 174 of the coupling member 170. Thus, the coupler 100 provides a convenient means of coupling the stainless steel distributor conduit 53 with the aluminum fluid tube or coupler 32 of the heat exchanger 11.

Operation

The operation of the described embodiment of the present invention is believed to be readily apparent and is briefly summarized at this point.

In its broadest aspect, the present invention relates to a heat exchanger system 10 which includes a metal tubular heat exchanger 11; a fluid distributor conduit 53 fabricated from a metal dissimilar to that of the heat exchanger 11, and wherein the fluid distributor conduit is connected in fluid flowing relation relative to the metal tubular heat exchanger 11; and a fluid distributor 50 made of a metal that is similar to that of the fluid distributor conduit 53, and which is connected in fluid flowing relation relative to the fluid distributor. In the invention as seen FIG. 1 and following, it should be understood that the metal tubular heat exchanger 11 is fabricated from aluminum and the dissimilar metal comprises steel or stainless steel. Still further, the fluid distributor 50 comprises a refrigerant distributor, and wherein the fluid distributor conduit comprises a plurality refrigerant distributor conduits 53 which are located in a predetermined pattern. In the present invention, the fluid distributor conduit 53 has an outside diameter dimension, and wherein the aluminum tubular heat exchanger 11 includes an aluminum heat exchanger tube 32 with an inside diameter dimension and an outside diameter dimension, and wherein the outside diameter dimension of the fluid distributor conduit 53 is less than the inside diameter dimension of the aluminum heat exchanger tube 32. In the arrangement as seen in the drawings, the fluid distributor conduit 53 has a first end 54 which is coupled in fluid flowing relation relative to the fluid distributor 50, and an opposite second end 55 which is coupled in fluid flowing relation relative to the aluminum heat exchanger tube 32. The second end 55 is circumscribed by an aluminum layer 61/161 which is joined to the aluminum heat exchanger tube 32 by means of welding and the like. In the two forms of the invention as shown in FIGS. 4 and 5, it will be appreciated that the aluminum layer 61/161, depending upon the form of the invention, has an outside diameter dimension substantially similar to the outside diameter dimension of the aluminum heat exchanger tube 32 with which it is coupled. Still further, it will be recognized by studying both FIGS. 4 and 5, that the second end 55 is telescopingly received, at least in part, within the aluminum heat exchanger tube 32. In one form of the invention, as seen in FIG. 5, it will be appreciated that the aluminum layer 161 is explosion welded to the steel or stainless steel layer 162. Still further, in another form of the invention as seen in FIG. 4, the aluminum layer 61 is roll bonded to the steel or stainless steel layer 62. In both forms of the invention as seen in FIGS. 4 and 5, it will be appreciated that a plurality of heat exchanger tubes 32 are provided, and the fluid distributor conduit 53 comprises a plurality of fluid distributor conduits which are individually coupled in fluid flowing relation relative to each of the respective heat exchanger tubes 32.

Another aspect of the present invention relates to a heat exchanger system 10 which includes a plurality of aluminum heat exchanger tubes 32; and a plurality of fluid distributor conduits 53 fabricated from steel or stainless steel. The heat exchanger system 10 further includes a fluid distributor 50 fabricated from steel or stainless steel, and wherein each of the plurality of fluid distributor conduits 53 is coupled in fluid flowing relation relative to the fluid distributor 50. Still further, the heat exchanger system 10 further includes a plurality of couplers 60/100 for joining each of the plurality of aluminum heat exchanger tubes 32 in fluid flowing relation relative to each of the plurality of fluid distributor conduits 53. In one form of the invention, as seen in FIG. 4, each of the plurality of couplers 60 has a main body which is formed from a first layer of aluminum 61, and a second layer of steel or stainless steel 62, which are roll bonded together, and which further define a passageway 93 therethrough. The main body has a first aluminum end 80, and an opposite, second, steel or stainless steel end 75, and wherein each of the plurality of aluminum heat exchanger tubes 32 are individually welded to the first aluminum end 80 of the couplers 60, and each of the plurality of fluid distributor conduits 53 is welded to the second steel or stainless steel end or surface 75 of one of the couplers. In the arrangement as seen in FIGS. 4 and 5, and as earlier discussed, the fluid distributor conduits 53 extend substantially through the coupler passageway 93, and are oriented, at least in part, within the adjoining aluminum heat exchanger tube 32. Still further, in the arrangements as seen in FIGS. 4 and 5, the outside diameter dimension of the coupler 60/100 is substantially equal to the outside diameter of the respective aluminum heat exchanger tubes 32.

In the form of the invention as seen in FIG. 5, each of the plurality of couplers 100 include a first aluminum layer 161 having a hardness of at least about T4; a second aluminum layer 164 juxtaposed relative to the first aluminum layer 161, and having a hardness less than that of the first aluminum layer 161; a third titanium layer 163 juxtaposed relative to the second aluminum layer 164; and a fourth steel or stainless steel layer 162 juxtaposed relative to the titanium layer 163, and wherein the first, second, third, and fourth layers 161, 164, 163 and 162, respectively, are explosively welded together. In the arrangement as discussed above, the first aluminum layer 161 has a thickness dimension of at least about 0.25 inches; the second aluminum layer 164 has a thickness dimension of at least about 0.04 inches; the third titanium layer 163 has a thickness dimension of at least about 0.010 inches; and the fourth steel or stainless steel layer 162 has a thickness dimension of at least about 0.5 inches; and wherein the outside diameter dimension of the respective couplers 100 is about equal to the outside diameter dimension of the respective aluminum heat exchanger tubes 32. In the second form of the invention as seen in FIG. 5, the coupler 100 further defines a passageway 193 therethrough, and wherein the fluid distributor conduit 53 extends substantially through the coupler passageway 193. Still further, a portion of the first aluminum layers 161 is received within the respective aluminum heat exchanger tubes 32.

More specifically relative to the form of the invention as seen in FIG. 4, a heat exchanger system 10 of the present invention includes a plurality of aluminum heat exchanger tubes 32; and a plurality of fluid distributor conduits 53 fabricated from steel or stainless steel. Still further, the heat exchanger system 10 as seen in FIG. 4 includes a fluid distributor 50 fabricated from steel or stainless steel and wherein each of the plurality of fluid distributor conduits 53 is coupled in fluid flowing relation relative to the fluid distributor 50; and a plurality of couplers 60 are provided for joining each of the of the plurality of aluminum heat exchanger tubes 32 in fluid flowing relation relative to each of the plurality of fluid distributor conduits 53. Each coupler 60 has a main body which has a first layer of aluminum 61, and a second layer of steel or stainless steel 62. A third layer of chromium 76 is provided and is located therebetween the first and second layers 61 and 62, respectively. The first, second, and third layers 61, 62 and 76, respectively, are roll bonded together. Each of the first, second, and third layers define a passageway 93 which extends therethrough the main body 66, and wherein the aluminum heat exchanger tubes 32 are individually welded to the first aluminum layer 61 of one of the couplers 60. The respective fluid distributor conduits 53 are individually welded to the second steel or stainless steel layer 62 of one of the couplers 60. As earlier discussed, the fluid distributor conduit 53 extends substantially through the coupler passageway 93 and are positioned, at least in part, within the aluminum heat exchanger tubes 53. In the arrangement as seen in FIG. 4, the first and second layers 61 and 62 have substantially the same thickness dimension and the third layer has a thickness dimension which is less than about 5% the thickness dimension of the first and second layers. In the arrangement as seen in FIG. 4, it is understood that the respective aluminum heat exchanger tubes 32 have an inside diameter dimension, and wherein the first layer of the coupler 61 defines a male member 70 which extends concentrically, outwardly therefrom, and which has an outside diameter dimension which is less than about the inside diameter dimension of the respective aluminum heat exchanger tubes 32. The male member 70 of the first aluminum layer 61 is received within one of the aluminum tubular heat exchanger tubes 32 as best seen by reference to FIG. 4.

With respect to the form of the invention as seen in FIG. 5, a heat exchanger system 10 includes, in one aspect of the invention, a plurality of aluminum heat exchanger tubes 32; and a plurality of refrigerant distributor conduits 53 fabricated from steel or an stainless steel alloy. Still further, the invention includes a refrigerant distributor 50 fabricated from steel or an stainless steel alloy, and wherein each of the plurality of refrigerant distributor conduits 53 are coupled in fluid flowing relation relative to the refrigerant distributor 50. Still further, the invention includes a plurality of couplers 100 for individually joining in fluid flowing relation each of the plurality of aluminum heat exchanger tubes 32 to each of the plurality of refrigerant distributor conduits 53. In this form of the invention as seen in FIG. 5, each of the plurality of couplers 100 comprises a substantially annular shaped first aluminum layer 161 which has a first hardness; a substantially annular shaped second aluminum layer 164 which has a second hardness that is less than the first hardness; a substantially annular shaped third titanium layer 163 juxtaposed relative to the second aluminum layer 164; and a substantially annular shaped fourth steel or an stainless steel alloy layer 162 juxtaposed relative to the third titanium layer 163. In this form of the invention, the respective layers are explosively welded together to form a ring shaped main body, and wherein the respective aluminum heat exchanger tubes 32 are welded to the outside facing surface of the first aluminum layer 161 of one of the couplers. Still further, the respective refrigerant distributor conduits 53 are welded to the outside facing surface of the fourth steel or stainless steel alloy layer 162 of one of the couplers 100. In this form of the invention, it should be understood that the plurality of couplers 100 each have a length dimension of about 0.5 inches to about 1.0 inch; and an outside diameter dimension of about ⅜ of an inch to about 1.0 inch. Still further, the first aluminum layer 161 has a thickness dimension of about 0.5 inches to about 0.75 inches; the second aluminum layer 164 has a thickness dimension of about 0.04 inches to about 0.10 inches; the third titanium layer 163 has a thickness dimension of about 0.01 inches to about 0.03 inches; and the fourth layer of steel or an stainless steel layer 162 has a thickness of about 0.5 inches to about 0.75 inches. As in the previous discussion, the respective couplers 100 further define a passageway 193 therethrough, and the respective fluid distributor conduits 53 extend through each of the coupler passageways 193.

Therefore, it will be seen that the present invention provides a convenient means whereby a stainless steel conduit providing a refrigerant may be expeditiously coupled to an aluminum conduit 32 of an aluminum tubular heat exchanger which is generally indicated by the numeral 11. The present couplers also provide a convenient means for avoiding shortcomings attendant with the prior art practices as described earlier in this application.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A heat exchanger system, comprising:

a plurality of aluminum heat exchanger tubes which have an outside diametral dimension, an inside diametral dimension, and a distal end;

a stainless steel refrigerant distributor;

a plurality of stainless steel fluid distributor conduits each having a proximal end which is coupled in fluid flowing relation relative to the stainless steel refrigerant distributor and an opposite distal end, and wherein the respective stainless steel fluid distributor conduits further have an outside diametral dimension, and an inside diametral dimension defining a passageway which extends therethrough, and wherein the outside diametral dimension of the respective stainless steel fluid distributor conduits is less than the inside diametral dimension of the respective aluminum heat exchanger tubes, and wherein the distal ends of the respective stainless steel fluid distributor conduits are telescopingly received within, and coaxially located relative to, the respective aluminum heat exchanger tubes; and a plurality of couplers for securing the respective stainless steel fluid distributor conduits in fluid flowing relation relative to each of the aluminum heat exchanger tubes, and wherein the respective couplers have a first, annular shaped aluminum end, and a second, annular shaped stainless steel end, and wherein the respective couplers have an outside diametral dimension which is substantially equal to or less than the outside diametral dimension of the respective aluminum heat exchanger tubes, and wherein the respective couplers define a continuous internal passageway which extends along the length thereof, and between the first annular shaped aluminum end, and the second annular shaped stainless steel end, and wherein first annular shaped aluminum end has a male coupling member which extends coaxially outwardly from first annular shaped aluminum end and which has an outside diametral dimension which is less than the inside diametral dimension of the respective aluminum heat exchanger tubes, and wherein the male coupling member is wholly received within the aluminum heat exchanger tubes, and wherein the distal end of the respective aluminum heat exchanger tubes is welded to the first annular shaped aluminum end at a location which is in spaced relation relative to the distal end thereof, and wherein the respective stainless steel fluid distributor conduits are received in the continuous passageway defined by the respective couplers, and further extends substantially through each of the couplers, and wherein the second annular shaped stainless steel end of the coupler is welded to the respective stainless steel fluid distributor conduits at a location where the stainless steel fluid conduit enters the continuous passageway which is defined by the coupler, and which is spaced from the distal end of the stainless steel fluid distributor conduit.

2. A heat exchanger system, as claimed in claim 1, and wherein the first annular shaped aluminum end, and the second annular shaped stainless steel ends are explosion welded together.

3. A heat exchanger system, as claimed in claim 1, and wherein the first annular shaped aluminum end and the second annular shaped stainless steel end are roll bonded together.

4. A heat exchanger system as claimed in claim 1, and wherein the first annular shaped aluminum end includes a first layer of aluminum having a hardness of at least about T4; and a second aluminum layer having a hardness less than the first layer.

5. A heat exchanger system as claimed in claim 4, and further comprising:

a third titanium layer positioned next to the second aluminum layer; and a fourth stainless steel layer, forming the second annular shaped stainless steel end, and wherein the first, second, third and fourth layers are explosively welded together.

6. A heat exchanger system as claimed in claim 1, and further comprising:

a layer chromium located between the first, annular shaped aluminum end, and the second annular shaped stainless steel end, and wherein the first annular shaped aluminum end; chromium layer, and second annular shaped stainless steel end are roll bonded together.

7. A heat exchanger system as claimed in claim 1, and wherein the first annular shaped aluminum end, and the second annular shaped stainless steel end have substantially the same length and thickness dimensions.

8. A heat exchange system, comprising:

a plurality of aluminum heat exchanger tubes having an outside diameter, and an inside diameter which defines a fluid passageway;

a stainless steel fluid distributor conduit coupled in fluid flowing relation relative to each of the fluid passageways defined by the respective aluminum heat exchanger tubes, and wherein the stainless steel fluid distributor conduit has an outside diameter dimension less than the inside diameter of the aluminum heat exchanger tube, and further has a distal end located telescopingly within the fluid passageway which is defined by the respective aluminum heat exchanger tubes; and a coupler for securing the distal end of the respective stainless steel fluid distributor conduits in fluid flowing relation relative to the respective aluminum heat exchanger tubes, and wherein each coupler has a first aluminum end which is telescopingly received, at least in part, in the passageway defined by the respective aluminum heat exchanger tubes, and a second stainless steel end, and wherein a passageway extends through the coupler from the first aluminum end, to the second stainless steel end, and wherein the individual stainless steel fluid distributor conduits extend through the passageway defined by the respective couplers so that the distal end of the stainless steel fluid distributor conduit is juxtaposed relative to the first aluminum end of the coupler, and wherein the respective aluminum heat exchanger tubes are welded to the first aluminum end of the coupler, and the second stainless steel end of the coupler is welded to the stainless steel fluid distributor conduit at a location which is spaced from the distal end of the stainless steel fluid distributor conduit.

* * * * *